United States Patent [19]

Chang et al.

[11] Patent Number: 4,876,136

[45] Date of Patent: Oct. 24, 1989

[54] LIPSTICK SAMPLING DEVICE

[75] Inventors: Robert W. H. Chang, Roseville, Minn.; Keith E. Relyea, St. Joseph Township, St. Croix County, Wis.

[73] Assignee: Minnesota Mining and Manufacturing Company, St Paul, Minn.

[21] Appl. No.: 64,862

[22] Filed: Jun. 22, 1987

[51] Int. Cl.[4] ..... B32B 3/04; A45D 40/00

[52] U.S. Cl. ..... 428/130; 132/320; 206/385; 206/822; 206/823; 424/63; 424/64; 428/121; 428/131; 428/138; 428/323; 428/537.5

[58] Field of Search ..... 132/88.7, 320; 428/212, 428/532.5, 121, 131, 130, 138, 323, 537.5; 206/385, 822, 823; 424/63, 64

[56] References Cited

U.S. PATENT DOCUMENTS

| | | | |
|---|---|---|---|
| 1,885,076 | 10/1932 | Bustamante . | |
| 2,606,565 | 8/1952 | Sage, Sr. | 132/88.7 |
| 2,735,435 | 2/1956 | Feinstein | 132/88.7 |
| 3,598,685 | 8/1971 | Lee et al. | 132/88.7 |
| 3,936,559 | 2/1976 | Newman | 428/212 |
| 4,507,382 | 3/1985 | Rousseau et al. | 430/275 |
| 4,611,611 | 9/1986 | Beal, Jr. | 132/88.7 |
| 4,725,495 | 2/1988 | Garbe et al. | 428/335 |
| 4,751,934 | 6/1988 | Moir et al. | 206/823 |
| 4,755,433 | 7/1988 | Patel et al. | 428/212 |

FOREIGN PATENT DOCUMENTS

D197084 10/1987 European Pat. Off. .

*Primary Examiner*—George F. Lesmes
*Assistant Examiner*—James B. Monroe
*Attorney, Agent, or Firm*—Donald M. Sell; Walter N. Kirn; Mark A. Litman

[57] ABSTRACT

Wax-base or emollient-base cosmetic compositions may be provided as samples on carrying sheets by providing the carrying sheet with a window sheet having a hole therein to expose said cosmetic composition, and a cover sheet over said window sheet to protect said exposed composition from incidental contact.

19 Claims, 2 Drawing Sheets

LIPSTICK SAMPLING DEVICE

BACKGROUND OF THE INVENTION

1. Field of the Invention

Cosmetic compositions having a wax or emollient base are provided in a structure suitable for sampling which is a multilayered article comprising a carrying sheet using (a) chemical impregnants which prevent absorption of oleic materials,(b) a film or sheet surface in contact with the surface of the cosmetic composition, and (c) an oleophilic binder between said paper and said cosmetic composition.

2. Background of the Art

Cosmetic samples of wax- or emollient-base compositions are often provided to the potential consuming public in conventional commercial forms. Lipstick tubes are available for general use at the sales counter as are bottles of foundation and other cosmetics. The open and general use of these samples by the public at large offers some potential health risks which should be avoided.

U.S. patent application Ser. No. 900,749, now abandoned filed on Aug. 27, 1986, titled Cosmetic Sampling Device discloses a multilayered structure for sampling cosmetic compositions comprising a paper base having an oleophobic agent within said paper, a solid cosmetic composition layer containing a wax or emollient component on at least a portion of one surface of said paper base and an opposed film or sheet surface in contact with said solid cosmetic composition layer.

U.S. patent application Ser. No. 925,828, filed Oct. 30, 1986, now U.S. Pat. No. 4,755,433 titled Lipstick Sampling Device discloses samples of solid cosmetic compositions having a wax or emollient carrying medium provided on paper carrying sheets. The paper is impregnated or coated with a material that prevents absorption of oleic materials and a sheet or film with an oleophilic surface in contact with the exposed surface of the cosmetic composition. An oleophilic binder layer is used between the paper and the cosmetic composition to provide good adherence of the composition to the carrying sheet.

European patent application 0 197 184 AZ published Oct. 15, 1986 discloses sampling devices for a number of cosmetic materials with advertising material thereon. Typically a paper base is provided with a barrier layer to seal the porous surface of the paper and to provide a smooth surface for the cosmetic material. FIG. 5 shows a transparent protective covering strip secured by a single glue line. The strip is lifted to expose the cosmetic material for use.

Each of these prior art disclosures provides a means for somewhat reducing the smearing, flowing, and migration of the cosmetic materials between, through, and around the samplers. However, none of these devices provides a truly effective barrier against migration of cosmetic samples with an oil or emollient therein, particularly lipstick samples.

SUMMARY OF THE INVENTION

The present invention has found that at least three separate layers, provided as three separate sheets or by a single sheet folded twice to form a Z cross section, is needed to provide even a minimally effective barrier in sampling devices for cosmetic materials containing at least 5% by weight of an emollient or wax material. Preferably a four layer construction is provided which provides a very effective seal against premature transfer or flow of the cosmetic material, yet which allows transfer when desired by the user.

DETAILED DESCRIPTION OF THE DRAWINGS

Figure 1:
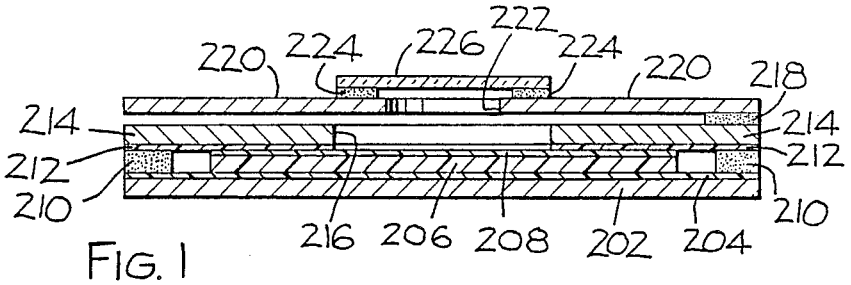
FIG. 1 is a cross-sectional view of an embodiment of the claimed invention comprising an unopened cosmetic sampler having the four layer construction.
Figure 2:
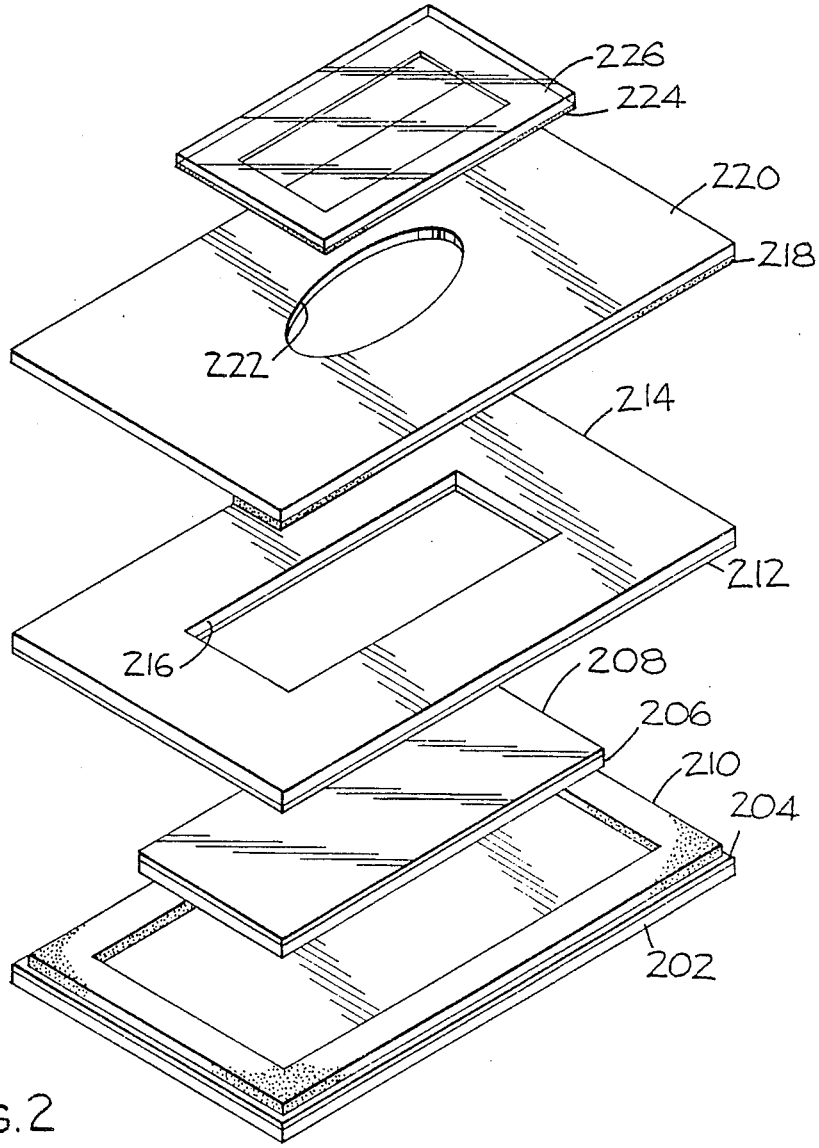
FIG. 2 is an exploded isometric view of the embodiment of the claimed invention shown in FIG. 1.

FIG. 1 and FIG. 2 show an unopened cosmetic sampler constructed of four separate structural layers comprising a carrier sheet 202, a window sheet 214, a cover sheet 220, and a transparent sheet 226. Carrier sheet 202 has on one surface a coating of oleophilic material 204. Upon a portion of this coated surface is a coating of cosmetic sample 206. On the surface of cosmetic sample 206 opposite carrier sheet 202 is a coating of thin frangible polymer 208. Overlaid on the cosmetic sample coated carrier sheet, and adhered thereto by adhesive 210, is window sheet 214. The surface of window sheet 214 facing cosmetic sample 206 has thereon a coating of oleophilic material 212. Additionally, window sheet 214 has hole 216 therein which overlaps at least a portion of cosmetic sample 206. Overlaid on window sheet 214, and adhered thereto along one edge by adhesive 218, is cover sheet 220. Cover sheet 220 has hole 222 therein which overlaps at least a part of hole 216 in window sheet 214. Covering hole 222 in cover sheet 220 is transparent sheet 226. Transparent sheet 226 has adhesive 224 along its periphery which secures it to cover sheet 220.

Figure 3:
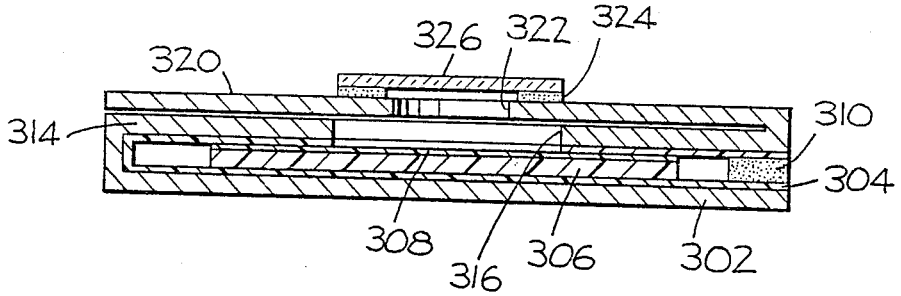
FIG. 3 is a cross-sectional view of an embodiment of the claimed invention comprising an unopened cosmetic sampler having the four layer construction, wherein three of the layers comprise a single sheet folded twice to form a Z cross-section.
Figure 4:
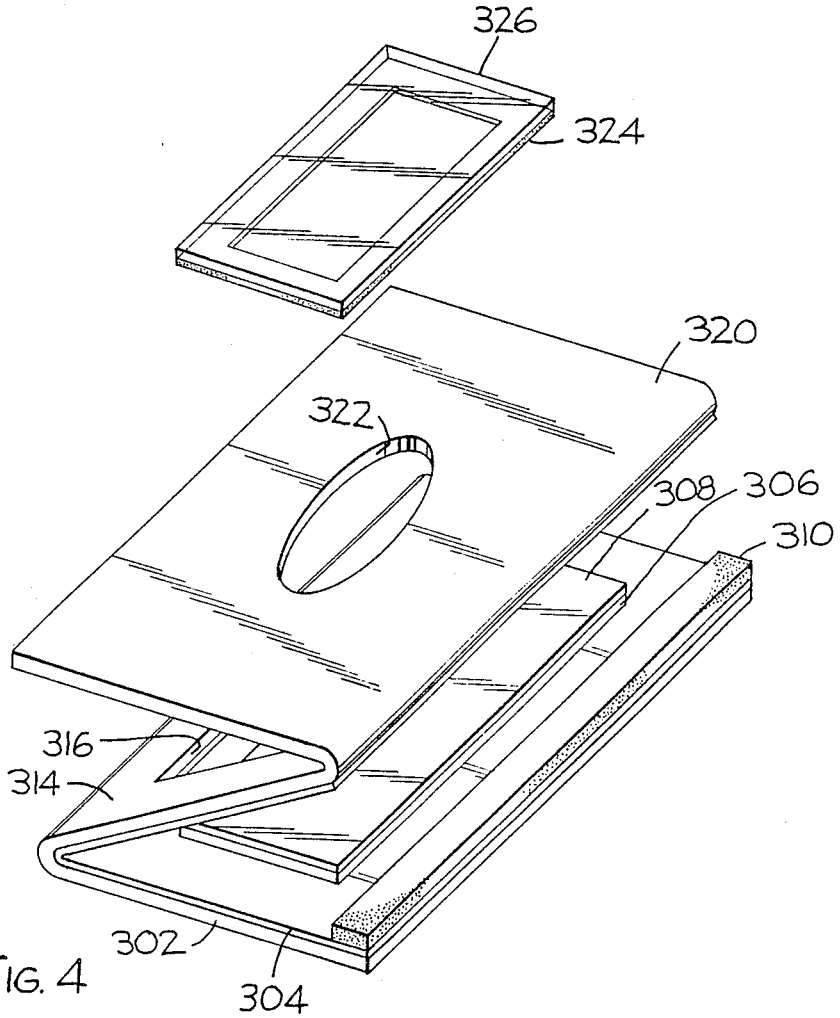
FIG. 4 is an exploded isometric view of the embodiment of the claimed invention shown in FIG. 3.

FIG. 3 and FIG. 4 show an unopened cosmetic sampler having a four layer construction wherein the three equal area structural layers: carrier sheet 302, window sheet 314, and cover sheet 320, are formed from a single sheet folded twice into a Z cross-section. Opposing surfaces of carrier sheet 302 and window sheet 314 are coated with oleophilic material 304. Between these two surfaces, and coated upon a portion of the coated surface of carrier sheet 302, is a coating of cosmetic sample 306. On the surface of cosmetic sample 306 opposite carrier sheet 302 is a coating of thin frangible polymer 308. Window sheet 314 having hole 316 therein is adhered to carrier sheet 302, along the edge opposite the fold, by adhesive 310. Hole 316 overlaps at least a portion of cosmetic sample 306. Cover sheet 320 overlays window sheet 314. Cover sheet 320 had hole 322 therein which overlaps at least a portion of hole 316. Covering hole 322 is transparent sheet 326, an independent structural layer. Transparent sheet 326 has adhesive 324 around its periphery which secures it to cover sheet 320.

DETAILED DESCRIPTION OF THE INVENTION

The three layer construction of the present invention comprises, in order, a carrier sheet on which the cosmetic sample is deposited, a window sheet with an opening that overlaps at least a portion of the cosmetic sample to enable it to be viewed and/or touched, and a cover sheet which overlaps the window sheet and protects the cosmetic material from casual contact. The theory of operation of this three layer material is that thickness of the window sheet forms the vertical walls of a box over the cosmetic sample and the cover sheet forms the top of a box to protect the sample from casual contact. This does in fact work reasonably well under conditions where the sampling device is not subjected to excessive pressure (forcing the cover sheet into contact with the sample) or where a relatively thick window sheet can be used.

The four layer construction also contains a carrier sheet and window sheet which may be identical to those of the three layer construction. The four layer construction then has a cover sheet with a second window which overlaps at least part of the window in the second sheet. This second window is covered by a transparent sheet which extends beyond each edge of the second window and lays between the first and second window sheet or is secured to the cover sheet around the periphery of the second window. Preferably the transparent sheet is on the face of the cover sheet away from the cosmetic sample. It is also preferred that the transparent sheet be tightly bonded in a continuous fashion, as by an adhesive, around the entire periphery of the window and close to or continuous with the edge of the second window.

The carrier layer may be any film or sheet material, but is preferably paper. More preferably the paper contains an oleophobic impregnant (penetrating composition) or has a barrier layer coated on one surface (e.g., a polyurethane barrier layer). Most preferably the carrier layer is a paper sheet with an oleophobic impregnant and an oleophilic coating thereon.

The window sheet may be composed of similar types of material as is the carrier sheet. The actual window sheet in a particular construction may be the same or different from the composition of the carrier sheet. The window may be any shape, such as round, oval, square, rectangular, lip-shaped, or the like. It is particularly desirable to have the surface of the window sheet facing the cosmetic composition to have an oleophilic coating on the surface in all areas that might contact the composition. Preferred composition for this purpose comprises vinyl resins (such as a copolymer of ethylene and a half lower alkyl ester of maleic andhydride) with particulate filler.

The cover sheet, both in the three-layer and four-layer construction, may also be composed of materials similar to those of the carrier and window sheets. Again, in any particular construction, the materials of the carrier, window and cover sheets may be the same or different.

The transparent material on the second window may be any transparent film forming material, and more preferably a polymeric resin such as polyester. The adhesive used to secure the transparent film to the cover sheet is any effective adhesive such as a solvent based adhesive, thermal adhesive or pressure sensitive adhesive.

Wax-base and emollient-base solid cosmetic compositions are not stable when coated in paper bases and therefore can not readily be sampled in that manner. The hydrocarbon, oleic, or lower molecular oleophilic materials seep into the paper and leave behind a cosmetic composition with less than optimal properties. Additionally, the appearance of oil stains around the cosmetic composition from that seepage is less than attractive to the potential buyer. Commercially available papers which are treated with polymeric and particulate compositions to prevent oil penetration have not been able to prevent penetration by these cosmetic compositions.

The use of penetrating compositions which are oleophobic has proved to be very useful in the solution of one aspect of this problem. These compositions should penetrate into the surface and preferably all the way through the paper to provide oleophobic properties. To be considered oleophobic, the treated paper should be able to be melt coated with a 0.1 mm thick 4 $cm^2$ patch of carnauba wax with a dye dissolved there so that after two weeks at 30° C. and 40% relative humidity, there is not more than a 15% gain in surface area with visible oil stain or coloration thereon. Preferably there is no more than a 5% gain in stained or colored surface area.

Additionally it has been found according to the present invention that it is highly desirable to provide a thin, frangible film of a polymer over the surface of the cosmetic material to prevent it from being smeared, yet enable it to be transferred easily to the skin as disclosed in U.S. patent application Ser. No. 925,828 filed on Oct. 30, 1986. The film preferably has a breaking strength of less than 2.5 kilograms per cm of width. Preferably the film should have a breaking strength of less than 1.5 kg/cm width, more preferably less than 1.0 kg/cm width, and most preferably less than 0.7 kg/cm width. The film should have a minimum strength of at least 0.02 kg/cm width.

The film can be applied generally over the sampling surface, covering the cosmetic and the substrate. It can be applied by spraying, extrusion, lamination, or any other conventional method. The film is applied generally at a dry coating weight of between $10^{-4}$ and $10^{-2}$ $g/cm^2$. Preferably it is coated at a weight between $2\times10^{-4}$ and $5\times10^{-3}$ $g/cm^2$. This approximates a thickness of between about 0.75 and 20 microns, preferably between about 1 and 12 microns. This will vary a good deal depending upon the physical properties of the polymer chosen.

Preferably the polymer is a hydrophilic polymer. Preferred compositions are ethylene maleic anhydride copolymers and copolymers with methyl vinyl ether, or monoalkyl esters (e.g., $C_1$ to $C_5$) of the maleic anhydride polymers or copolymers. Cellulose acetate esters (e.g., cellulose acetate butyrate and proprionate), poly(N-methyl vinylpyrollidone), ethylcellulose, polyacrylates, hydroxypropylcellulose, and the like. The cellulosic polymers and ethylene maleic anhydride polymers and copolymers are preferred.

The polymeric film should be brittle if possible so that there is a reduced tendency of the covering film to "skin" or be removed as a film. The lipstick should be removable as a waxy material rather than as a mixture of film and wax. The brittleness and thinness of the film contribute to this.

The presence of particulates, particularly hydrophobic particles (inorganic particles such as silica) in this frangible polymeric coating on the cosmetic composition significantly improves the performance of this layer in reducing transfer of material. Usually there is from 0.05 to 1% by weight of particles less than one micron in average diameter is preferred.

One problem has been encountered in the use of paper, even with oleophobic penetrating compositions. The composition renders the paper surface oleophobic so that there is a poor bond established between the cosmetic composition and the paper. Although the entire cosmetic composition layer does not release from the substrate, small patches of the composition can be removed. This gives an unsightly appearance to the sampler.

It has been found in the practice of the present invention that a primer coating over said treated paper surface can overcome this adhesion problem and not increase the discoloration effect if the primer is an oleophilic wax or polymer and the coating has a thickness of between 0.5 and 50 microns, preferably between 0.5 and 10 microns. Oleophilic waxes such as carnauba wax, beeswax, candlewax, and the like may be used. Particularly desirable polymers include poly(N-vinylpyrrolidone), polyacrylates (e.g., polymethylmethacrylate, poly-n-butylmethacrylate), cellulose esters (e.g., cellulose acetate butyrate, cellulose acetate proprionate), poly(vinyl alcohol) and the like. Hydroxyalkylcellulose work less preferably. These materials are preferably coated out as polymeric solutions in order to insure a thin even coating on the surface. Printing inks and varnishes may also be used as the primer coating.

Control of the thickness of the coating, is believed to be desirable in preventing the primer from laterally transmitting any dye. It is preferred that the coating be 25 microns or less, and more preferred that it be 15 microns or less.

Even with these compositions, the emollient based cosmetics are persistent in their efforts to migrate and transfer away from the areas in which they were originally printed. This is particularly true when the compositions are subjected to pressure and/or elevated temperatures (e.g., above 30° C.). That is why the additional construction requirements of the present invention were required.

The oleophobic penetrating composition can be selected from a number of commercially available types of materials such as fluorocarbons (e.g., Scotchban TM, a salt of a highly fluorinated polymer or a fluorochemical phosphate ester) and fluorochemical phosphates. Other materials such as fluorinated polymers and compositions such as those described in U.S. Pat. No. 4,529,658 are also useful. The disclosure of that patent is incorporated herein by reference with respect to the compositions and disclosure of chemical materials described therein. The preferred composition is a fluorochemical polymer, particularly those derived from about 60 to 80% of fluorochemical acrylates, 1 to 30% alkyl or alkoxyalkyl acrylates (inclusive also of methacrylates), 2 to 15% glycidyl acrylate (inclusive also of methacrylates), 1 to 6% cationic acrylates (inclusive also of methacrylates) and 0 to 20% vinylidene chloride. These materials are used in amounts of 0.002 to 3% by weight of paper in the base, preferably 0.02 to 2% by weight of said paper. Other fluorochemical polymers are used in the same weight ratios.

The cosmetic compositions are limited to those containing at least 5% by weight of an emollient or wax material. Compositions with lower contents of these oleic materials do not need to practice the present invention. Other conventional cosmetic additives may of course be present in the cosmetic layer. Such materials as polymeric binders, oils, water, dyes, pigments, moisturizers, fragrances, filler, antioxidants, emulsifying agents, and the like are often present.

The cosmetic composition is preferably applied to the sampler in sufficient quantity so that it may be transferred to a person's skin in amounts that will approximate normal usage of the cosmetic. Coating thicknesses of at least 10 microns and more preferably at least 50 microns are desirable. Coating thicknesses in the range of 0.01 to 0.3mm and preferably 0.02 to 0.1mm are generally used.

Stacks of sampler sheets are strippably adhered together at the edges or through the cosmetic material as an adhesive. This last construction can be effected by having the backside of the upper samples, in contact with the cosmetic coating layer, coated with or laminated to the oleophobic layer.

These and other aspects of the present invention will be described in the following non-limiting examples.

EXAMPLE 1

A sheet of two-side coated printing stock was used in this example. The paper was coated on both sides with a clay and polymer coating composition. The sheet of paper was treated with 1% by weight of the paper of Scotchban TM oil repellent, an oligomeric fluorinated ester. Both the coating and the paper itself absorbed the oil repellent. One coated surface of the coated sheets was coated with a 4 mil ($1\times10^{-4}$m) wet thickness coating of a 10% solids solution of poly(N-vinyl pyrollidone) and oven dried at 105° C.. This produced a coating of average thickness between 4 and 8 microns. A stick of commercially available wax base lipstick was gently melted and hand coated onto one surface of the paper bases.

A window was cut in a second sheet of paper coated, impregnated and again coated as was the first sheet. This window sheet was adhesively secured to the carrier sheet with the window partially overlaying the cosmetic sample.

An untreated sheet of two-side coated paper was used as the cover sheet. This was secured to the sampler by adhesive tape along one edge of the cover sheet and sampler.

EXAMPLE 2

Example 1 was separated except that a second window, coextensive with the first window, was cut into the cover sheet. A transparent film of poly(ethyleneterephthalate) was adhesively secured around the edge of the second window to visually expose the cosmetic sample.

EXAMPLE 3

A single sheet of two-side coated paper was impregnated and coated as in Example 1. The sheet was folded twice into equal areas to form a Z cross section. On the first folded area a lipstick cosmetic sample was coated on the face of the folded sheet facing the other two folded sections. On the center folded section, a window was cut which overlaid the cosmetic sample.

The material of Example 2 could withstand more heat and/or pressure than the materials of Examples 1 and 3 before allowing migration of the cosmetic sample.

EXAMPLE 4

Example 3 was repeated except that a polyvinylidene chloride film ($7.6\times10^{-2}$mm) was pressed onto the cosmetic coating while it was warm. This protective layer further prevented transfer and smearing of the lipstick composition.

EXAMPLE 5

Example 3 was repeated except that a frangible protective coating was provided over the lipstick composition. An approximately thirty micron dry coating of a copolymer (half methyl ester of maleic anhydride and ethylene) was coated from solution over the cooled-lipstick composition. The solution also contained 5% weight by solids of hydrophobic, fumed silica. This frangible coating on the lipstick composition was particularly useful in reducing meaning and transfer problems from the composition.

What is claimed is:

1. A multilayered structure for sampling cosmetic compositions containing at least 5% by weight of emollients or waxes, said structure comprising a carrier sheet, a window sheet and a cover sheet, said carrier sheet having a portion of at least one surface thereof with a coating of said cosmetic composition thereon, said window sheet having a hole therein which exposes at least a portion of said coating of cosmetic composition, and said cover sheet covering said hole in said window sheet wherein said carrier sheet, window sheet and cover sheet are portions of the same sheet formed by two folds of said same sheet to form a Z cross section.

2. The structure of claim 1 wherein said carrier sheet comprises paper which is resistant to penetration by said emollient or waxes.

3. The structure of claim 2 wherein said cover sheet has a hole therein which overlaps and corresponds at least in part to the hole in said window sheet, and said hole in said cover sheet has covering it an oleophobic polymeric film.

4. The structure of claim 2 wherein said carrier sheet is resistant to penetration by emollient or waxes because of a treatment selected from the group consisting of impregnation by oleophobic agents or a surface coating with an oleophobic polymer.

5. The structure of claim 4 wherein said cover sheet has a hole therein which overlaps and corresponds at least in part to the hole in said window sheet, and said hole in said cover sheet has covering it an oleophobic polymeric film.

6. The structure of claim 4 wherein said treatment comprises impregnation with an oleophobic agent and there is a further coating on said carrier sheet comprising an oleophilic resin.

7. The structure of claim 6 wherein said cover sheet has a hole therein which overlaps and corresponds at least in part to the hole in said window sheet, and said hole in said cover sheet has covering it an oleophobic polymeric film.

8. The structure of claim 7 wherein said oleophilic polymeric film is adhered to the surface of said cover sheet furthest from said cosmetic composition.

9. The structure of claim 8 wherein said cosmetic composition comprises lipstick.

10. The structure of claim 9 wherein said lipstick has a frangible polymeric coating adhered to its surface.

11. The structure of claim 10 wherein said frangible polymeric coating contains particulate material.

12. The structure of claim 1 wherein said cover sheet has a hole therein which overlaps and corresponds at least in part to the hole in said window sheet, and said hole in said cover sheet has covering it an oleophobic polymeric film.

13. The structure of claim 12 wherein said oleophobic polymeric film is transparent.

14. The structure of claim 13 wherein said oleophobic polymeric film is adhered to the surface of said cover sheet furthest from said cosmetic composition.

15. The structure of claim 12 wherein said cosmetic composition comprises lipstick.

16. The structure of claim 15 wherein said lipstick has a frangible polymeric coating adhered to its surface.

17. The structure of claim 1 wherein said cosmetic composition comprises lipstick.

18. The structure of claim 17 wherein said lipstick has a frangible polymeric coating adhered to its surface.

19. The structure of claim 18 wherein said frangible polymeric coating contains particulate material.

* * * * *